US005743245A

United States Patent [19]

Mizek

[11] Patent Number: 5,743,245

[45] Date of Patent: Apr. 28, 1998

[54] ARROW REST

[75] Inventor: Robert S. Mizek, Downers Grove, Ill.

[73] Assignee: New Archery Products Corp., Forest Park, Ill.

[21] Appl. No.: 766,284

[22] Filed: Dec. 13, 1996

[51] Int. Cl.[6] ..... F41B 5/22

[52] U.S. Cl. ..... 124/44.5

[58] Field of Search ..... 124/24.1, 25.6, 124/44.5, 86; 224/916; 248/645

[56] References Cited

U.S. PATENT DOCUMENTS

| | | | |
|---|---|---|---|
| D. 346,845 | 5/1994 | Sears | D22/107 |
| 3,116,730 | 1/1964 | Tingley | 224/916 X |
| 3,406,676 | 10/1968 | Dye . | |
| 3,865,096 | 2/1975 | Troncoso, Jr. . | |
| 3,935,854 | 2/1976 | Troncosco, Jr. . | |
| 4,577,612 | 3/1986 | Zell . | |
| 4,664,093 | 5/1987 | Nunemaker . | |
| 4,686,956 | 8/1987 | Troncoso, Jr. . | |
| 4,748,964 | 6/1988 | Troncoso, Jr. . | |
| 4,827,895 | 5/1989 | Troncoso, Jr. . | |
| 4,899,716 | 2/1990 | Martin et al. . | |
| 4,947,823 | 8/1990 | Larson . | |
| 5,005,554 | 4/1991 | Shepley et al. | 124/24.1 |
| 5,009,215 | 4/1991 | Ludwig | 124/44.5 |
| 5,062,407 | 11/1991 | Newbold | 124/44.5 |
| 5,065,731 | 11/1991 | Smith | 124/44.5 |
| 5,137,006 | 8/1992 | Gallops | 124/44.5 |
| 5,213,090 | 5/1993 | Tone | 124/44.5 |
| 5,285,764 | 2/1994 | Mertens | 124/44.5 |
| 5,365,912 | 11/1994 | Pittman | 124/44.5 |
| 5,372,119 | 12/1994 | Kidney | 124/44.5 |

*Primary Examiner*—John A. Ricci
*Attorney, Agent, or Firm*—Speckman, Pauley & Fejer

[57] ABSTRACT

An arrow rest preferably having three or more flanges that extend outward in a generally radial direction. The flanges are peripherally spaced with respect to each other and form a clearance cutout between flange surfaces that face or oppose each other. The flanges or another suitably shaped body form two or more clearance cutouts that each accommodate a different diameter of a differently sized arrow shaft.

18 Claims, 2 Drawing Sheets

ARROW REST

BACKGROUND OF THE INVENTION

1. Field of the Invention

This invention relates to an arrow rest that can be rotated or otherwise moved into different positions wherein each position of the same arrow rest accommodates a different diameter of differently sized arrow shafts.

2. Description of Prior Art

Some conventional arrow rests, often referred to as shoot-thru arrow rests, allow an arrow to discharge without the fletching or the vanes touching the arrow rest. For example, U.S. Pat. Nos. 5,137,006 and 5,285,764 each disclose two opposing support arms through which one vane may pass during discharge of the arrow.

Other conventional arrow rests support an arrow shaft at two positions lower than the centerline of the arrow shaft. For example, U.S. Pat. Nos. 3,865,096, 3,935,854, 4,686,956, 4,748,964 and 4,827,895 teach supporting members that form point contact or line contact with an arrow shaft at two positions lower than a center-line of the arrow shaft. In such conventional arrow rests, the fletching or vane does not pass through supporting members of the arrow rest but rather clears the arrow rest.

Most archery arrows have three vanes mounted on an external surface of the arrow shaft. The three vanes are usually positioned with approximately 120° spacing between the vanes.

Once set in a particular position, many conventional arrow rests that allow the fletching to clear the arrow rest can accommodate only one size of arrow shaft diameter. But because arrow shafts are now manufactured with outside diameter lengths in a wide range, it is often necessary to make complicated and time-consuming mechanical adjustments to the arrow rest when changing to an arrow shaft with a different diameter. It is apparent there is a need for one arrow rest that can be quickly and easily moved from one position to another to accommodate different diameters of differently sized arrow shafts.

SUMMARY OF THE INVENTION

It is one object of this invention to provide an arrow rest that can be rotated about a longitudinal axis of the arrow rest to accommodate different diameters of differently sized arrow shafts.

It is another object of this invention to provide an arrow rest that does not interfere with the fletching or vanes of an arrow, as the arrow discharges over the arrow rest.

It is another object of this invention to provide an arrow rest that has relatively minimal frictional contact with an arrow shaft which the arrow rest supports.

It is still another object of this invention to provide an arrow rest that has no moving mechanical parts but yet can accommodate different diameters of differently sized arrow shafts.

It is yet another object of this invention to provide an arrow rest that can be quickly and easily moved from one position to another to accommodate different diameters of differently sized arrow shafts.

The above and other objects are accomplished with different preferred embodiments of an arrow rest according to this invention. In one preferred embodiment, the arrow rest has at least three flanges that extend outward in a generally radial direction. Flanges which are adjacent to one another are peripherally spaced with respect to each other. Two adjacent flanges form a clearance cutout between opposing flange surfaces of the adjacent flanges. The clearance cutout is intended to provide support for an arrow shaft at only two contact areas while eliminating contact between the arrow rest and the arrow shaft at all other areas. Thus, any suitable shape of the clearance cutout which reduces fictional contact between the arrow rest and the arrow shaft is preferred but not necessary. The clearance cutout can conform precisely to the shape of an external surface of the arrow shaft but will not offer reduced fictional contact as compared to the preferred embodiment wherein fictional contact occurs only at the two contact areas.

In another preferred embodiment according to this invention, the clearance cutouts can be formed in a body which may or may not resemble or form a flange. However each clearance cutout is formed, it is important for the body or the flanges to not interfere with but allow clearance for the fletching or vanes as an arrow is discharged over the arrow rest.

BRIEF DESCRIPTION OF THE DRAWINGS

The above-mentioned and other features and objects oft his invention will be better understood from the following detailed description when taken in view of the drawings wherein.

DESCRIPTION OF PREFERRED EMBODIMENTS

Figure 1:
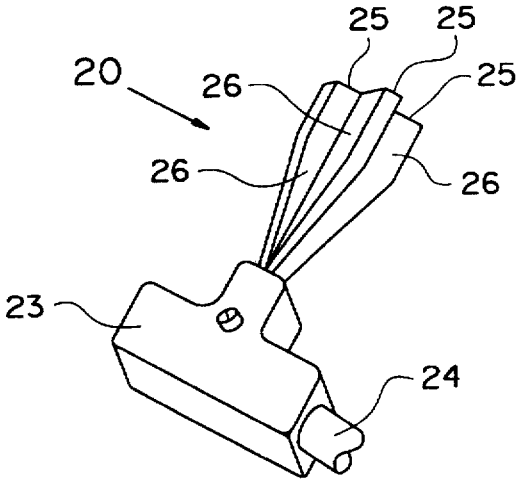
FIG. 1 is a perspective view of an arrow rest mounted within a pivotal mounting block, according to one preferred embodiment of this invention.

Referring to FIG. 1, arrow rest 20 is shown in a perspective view. Arrow rest 20 is fixed with respect to mounting body 23. Mounting shaft 24 is fixed with respect with mounting body 23. Mounting shaft 24 can be attached to or connected with respect to any conventional mounting bracket that is fixed or that pivots with respect to an archery bow.

Many conventional mounting brackets allow mounting shaft 24 to rotate with respect to the archery bow. Arrow rest 20 according to this invention can be used in either a stationary or fixed mode of operation or a rotational or pivotal mode of operation. When arrow shaft 15 is discharged over arrow rest 20, arrow rest 20 pivots downward and away from arrow shaft 15, in the rotational mode of operation.

Arrow rest 20 comprises at least three flanges 25 which extend outward in a generally radial direction. As shown in FIGS. 2–6, in one preferred embodiment of this invention arrow rest 20 has four flanges 25.

Flanges 25 are peripherally spaced with respect to each other. In the preferred embodiment shown in FIG. 6, each of the four angles of inclusion 27 between peripherally adjacent flange surfaces 26 of flanges 25 is approximately 90°. It is apparent that any other suitable value for angle of inclusion 27 can be used and will normally depend upon the number of flanges 25.

Figure 3:
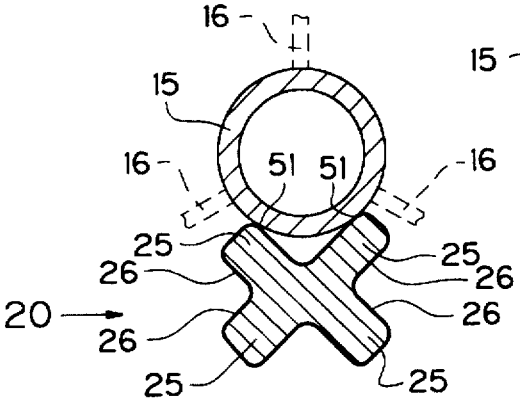
FIG. 3 is a sectional view take along line 3—3, as shown in FIG. 2.
Figure 2:
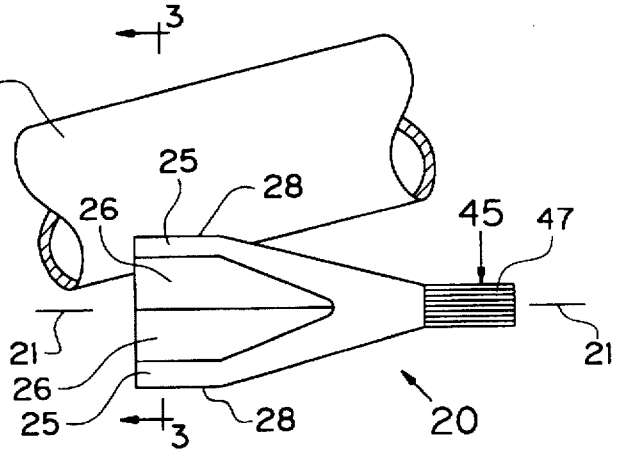
FIG. 2 is a side view of an arrow rest, according to one preferred embodiment of this invention.
Figure 4:
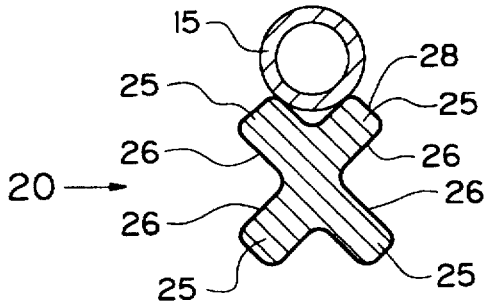
FIG. 4 is the sectional view shown in FIG. 3, rotated 90° clockwise about a longitudinal axis of the arrow rest.
Figure 5:
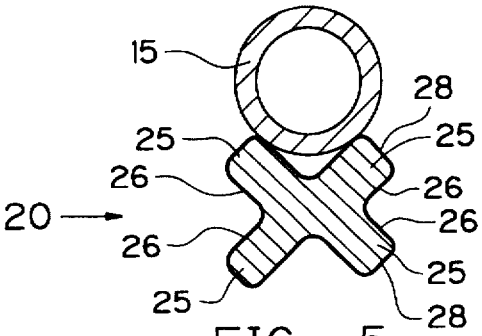
FIG. 5 is the sectional view shown in FIG. 3, rotated 180° about a longitudinal axis of the arrow rest.
Figure 6:
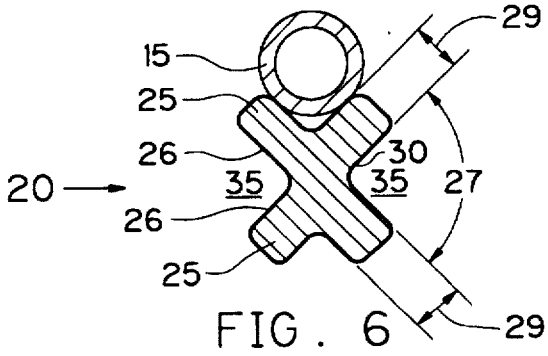
FIG. 6 is the sectional view shown in FIG. 3, rotated 270° clockwise about a longitudinal axis of the arrow rest.

FIGS. 4–6 show arrow rest 20 rotated 90°, 180° and 270° clockwise, respectively, from the position shown in FIG. 3. FIGS. 3–6 illustrate how arrow rest 20 accommodates different diameters of differently sized arrow shafts 15 by rotating or moving arrow rest 20 from one position to another. FIG. 2 shows longitudinal axis 21 of arrow rest 20 positioned at an angle with respect to a longitudinal axis of arrow shaft 15, which is preferred but not necessary.

In another preferred embodiment according to this invention, arrow rest 20 may comprise more than four flanges 25. As the number of flanges 25 is increased, angle of inclusion 27 decreases and thus the radial length of each flange 25 increases, in order to accommodate similarly sized arrow shafts 15. For similar reasons, arrow rest 20 with only three flanges 25 can have flanges 25 with a lesser radial length than arrow rest 20 with four or more flanges 25.

As shown in FIG. 6, peripherally adjacent flange surfaces 26 form clearance cutout 35 between adjacent flange surfaces 26 that face each other. In one preferred embodiment according to this invention, as shown in FIGS. 3–6, each clearance cutout 35 is formed as a groove having a generally V-shaped cross section within a plane which is perpendicular to longitudinal axis 21. FIGS. 3–6 show sectional views which are within a plane which is generally perpendicular to longitudinal axis 21. Although not necessary, as shown in FIGS. 3–6, flange surface 26 is generally planar.

The particular shape of clearance cutout 35 can be selected or designed to accomplish certain intended results. For example, although not necessary it is preferred that arrow shaft 15 contact opposing or facing flange surfaces 26 at contact areas 51, such as shown in FIG. 3. Also as an example, as arrow shaft 15 is discharged over arrow rest 20, vanes 16 clear or do not touch any portion of arrow rest 20, as shown by the dashed lines in FIGS. 3 and 11. Thus, it is preferred to choose dimensions and angles as well as a number of flanges 25 that accomplish clearance of vanes 16 and that accomplish either general point contact or general line contact between arrow shaft 15 and flange surface 26, such as at contact areas 51.

Conventional arrows nominally have three vanes 16 that are about equally spaced about a circumference of the arrow shaft. Thus, the dimensions and angles as well as number of flanges 25 are preferably selected so that the entire arrow rest 20 fits within the approximate 120° arc segment between two adjacent vanes 16, in order to maintain clearance.

As shown in FIG. 6, each flange 25 has a different thickness 29. Although not necessary, such geometry provides for differently sized V-shaped grooves for accommodating at least four different diameters of four differently sized arrow shafts 15.

Rotation means 45 are used to rotate flanges 25 and/or arrow rest 20 about longitudinal axis 21. FIG. 2 shows rotation means 45 comprising shaft 47. When shaft 47 is mounted within a corresponding bore within mounting body 23, for example, arrow rest 20 can be rotated into either of the positions shown in FIGS. 3–6, and thereby accommodate at least four different diameters or ranges of diameters of four differently sized arrow shafts 15.

As shown in FIG. 2, each flange 25 diverges along at least a portion of a longitudinal length of flange 25, in a direction of forward flight of arrow shaft 15 which is discharged over arrow rest 20. Although not necessary, such diverging aspect promotes complete clearance of the fletching or vanes with respect to arrow rest 20 when arrow shaft 15 is discharged, particularly when arrow rest 20 pivots downward and away from arrow shaft 15.

It is important for arrow rest 20 to have at least two clearance cutouts 35, for the purpose of accommodating at least two different diameters or ranges of diameters of differently sized arrow shafts 15. In another preferred embodiment according to this invention, as shown in FIGS. 7–12, less distinctive flanges 25 are formed as compared to those shown in FIGS. 1–6.

Figure 9:
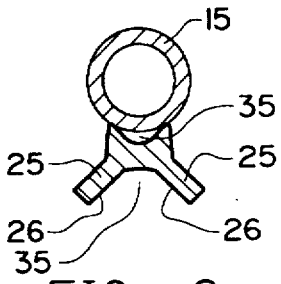
FIG. 9 is a sectional view taken along line 9—9, as shown in FIG. 8.
Figure 10:
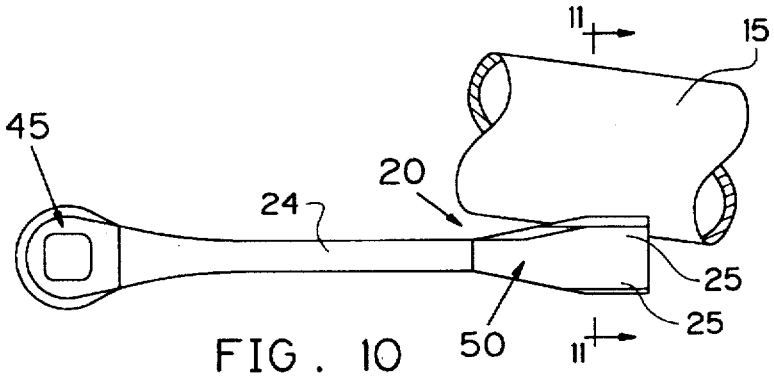
FIG. 10 is a side view, opposite the side view shown in FIG. 8, of the arrow rest shown in FIG. 7.
Figure 11:
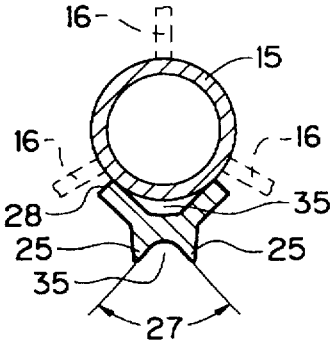
FIG. 11 is a sectional view taken along line 11—11, as shown in FIG. 10.

As shown in FIGS. 9 and 11, body 50 forms two clearance cutouts 35. Also as shown in FIGS. 9 and 11, body 50 forms two contact areas 51 at each clearance cutout 35, which is similar to the two contact areas 51 formed by two adjacent flanges 25 as shown in FIG. 3. Each clearance cutout 35 is shaped so that body 50 supports arrow shaft 15, preferably at two locations, such as contact areas 51. However, if relatively increased friction between arrow shaft 15 and arrow rest 20 is tolerable, it is possible for clearance cutout 35 to have an arcuate shape which precisely matches an external surface shape of arrow shaft 15.

Figure 7:
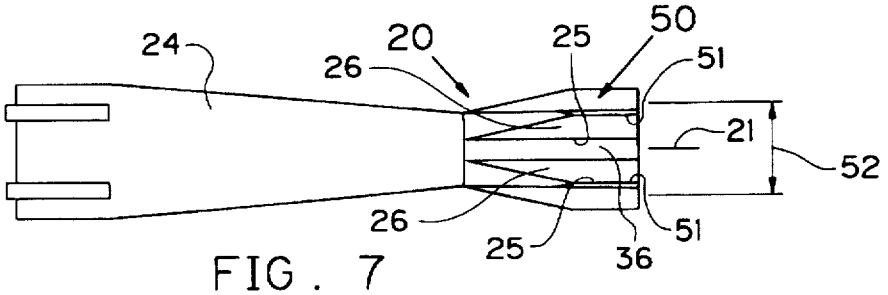
FIG. 7 is a top view of an arrow rest preferably constructed of a flexible material, according to another preferred embodiment of this invention.
Figure 8:
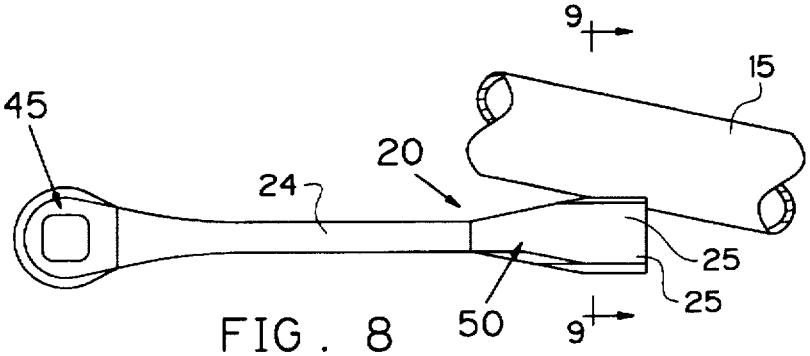
FIG. 8 is a side view of the arrow rest shown in FIG. 7.
Figure 12:
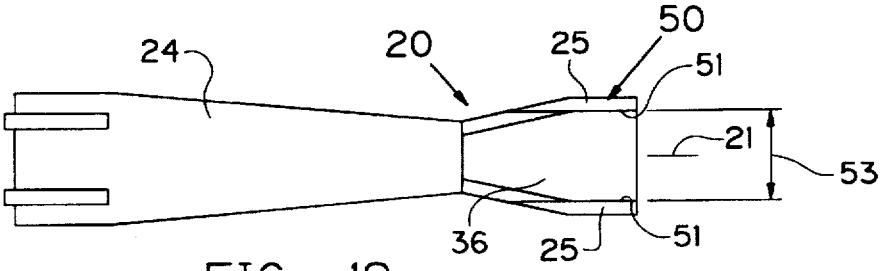
FIG. 12 is a bottom view of the arrow rest shown in FIG. 7.

According to certain preferred embodiments of this invention, there is preferably either general point contact or general line contact between arrow rest 20 and arrow shaft 15. Throughout the specification and in the claims, general point contact is intended to relate to a practical meaning of point contact, such as where contact area 51 is relatively small, rather than a theoretical meaning. Likewise, as used throughout the specification and in the claims, general line contact is intended to relate to a practical meaning of line contact rather than a theoretical meaning. In a preferred embodiment according to this invention, such as shown in FIGS. 7 and 12, first distance 52, measured between two contact areas 51 of one clearance cutout 35 is different than second distance 53, which is measured between two contact areas 51 of another clearance cutout 35. As shown in FIGS. 7 and 12, first distance 52 is less than second distance 53, and thus arrow rest 20 accommodates at least two different diameters of differently sized arrow shafts 15.

As shown in FIGS. 7, 9, 11 and 12, clearance cutout 35 has a generally V-shaped groove. Other suitable shapes can be selected to accomplish the same results: forming general point contact or general line contact between arrow shaft 15 and arrow rest 20; as well as vanes 16 clearing arrow rest 20 upon discharge of arrow shaft 15.

In the preferred embodiment shown in FIGS. 7–12, mounting shaft 24 acts as a cantilever to provide pivot action of arrow rest 20. Mounting shaft 24 can be constructed of any suitable material that has a desired stiffness for an intended deflection at the end of mounting shaft 24 that is attached to arrow rest 20.

Connection means are preferably used to secure flanges 25 with respect to each other. For example, the connection means may comprise flanges 25 injection molded, machined or otherwise formed as an integral unit. In another preferred embodiment, the connection means may comprise a base rod or other similar structure to which flanges 25 are secured in any suitable manner known to those skilled in the Shaft 47 may comprise a knurled surface or other toughened structure that increases the coefficient of fiction of the external surface of shaft 47. Shaft 47 can even be externally threaded; however, rotating arrow rest 20 using external threads on shaft 47 will result in movement of arrow rest 20 along longitudinal axis 21.

While in the foregoing specification this invention has been described in relation to certain preferred embodiments thereof, and many details have been set forth for propose of illustration, it will be apparent to those skilled in the art that the invention is susceptible to additional embodiments and that certain of the details described can be varied considerably without departing from the basic principles of the invention.

What is claimed is:

1. An arrow rest comprising:

at least three flanges extending outward in a generally radial direction, said at least three flanges peripherally spaced with respect to each other, each said flange having at least one flange surface, peripherally adjacent said flange surfaces forming a clearance cutout between said flange surfaces that face each other, a first distance between a first pair of opposing arrow contact areas of said flanges of one said clearance cutout being different than a second distance between a second pair of opposing arrow contact areas of said flanges of another said clearance cutout; and connection means for securing said flanges with respect to each other.

2. An arrow rest according to claim 1 having four said flanges.

3. An arrow rest according to claim 2 wherein an angle of inclusion between said peripherally adjacent said flange surfaces is approximately 90°.

4. An arrow rest according to claim 1 further comprising rotation means for rotating said at least three flanges about a longitudinal axis of the arrow rest.

5. An arrow rest according to claim 4 wherein said rotation means comprise a shaft connected with respect to a base portion of each said flange.

6. An arrow rest comprising:

at least three flanges extending outward in a generally radial direction, said at least three flanges peripherally spaced with respect to each other, each said flange having at least one flange surface, peripherally adjacent said flange surfaces forming a clearance cutout between said flange surfaces that face each other;

connection means for securing said flanges with respect to each other; and said clearance cutout formed as a groove having a generally V-shaped cross section within a plane perpendicular to a longitudinal axis of the arrow rest.

7. An arrow rest comprising:

at least three flanges extending outward in a generally radial direction, said at least three flanges peripherally spaced with respect to each other, each said flange having at least one flange surface, peripherally adjacent said flange surfaces forming a clearance cutout between said flange surfaces that face each other;

connection means for securing said flanges with respect to each other; and said flange surface being generally planar.

8. An arrow rest comprising:

at least three flanges extending outward in a generally radial direction, said at least three flanges peripherally spaced with respect to each other, each said flange having at least one flange surface, peripherally adjacent said flange surfaces forming a clearance cutout between said flange surfaces that face each other;

connection means for securing said flanges with respect to each other; and at least two of said flanges different thicknesses.

9. An arrow rest comprising:

at least three flanges extending outward in a generally radial direction, said at least three flanges peripherally spaced with respect to each other, each said flange having at least one flange surface, peripherally adjacent said flange surfaces forming a clearance cutout between said flange surfaces that face each other;

connection means for securing said flanges with respect to each other; and an outer radial surface of each said flange diverging along at least a portion of a longitudinal length of said flange in a direction of forward flight of an arrow shaft discharged over the arrow rest.

10. (Amended) An arrow rest for supporting an arrow shaft, the arrow rest comprising:

a body having at least two clearance cutouts, at each said clearance cutout said body having two contact areas peripherally spaced with respect to each other, and each said clearance cutout shaped to support the arrow shaft at two locations; and a first distance between said two contact areas of one said clearance cutout different than a second distance between said two contact areas of another said clearance cutout.

11. An arrow rest according to claim 10 wherein the body has four clearance cutouts.

12. An arrow rest for supporting an arrow shaft, the arrow rest comprising:

a body having at least into clearance cutouts, at each said clearance cutout said body having two contact areas peripherally spaced with respect to each other, and each said clearance cutout shaped to support the arrow shaft at two locations; and said at least two clearance cutouts each formed as a groove having a generally V-shaped cross section within a plane perpendicular to a longitudinal direction of the arrow rest.

13. An arrow rest for supporting an arrow shaft, the arrow rest comprising:

a body having at least two clearance cutouts, at each said clearance cutout said body having two contact areas peripherally spaced with respect to each other, and each said clearance cutout shaped to support the arrow shaft at two locations; and said contact areas each formed as a general point for forming generally point contact with an arrow shaft.

14. An arrow rest for supporting an arrow shaft, the arrow rest comprising:

a body having at least two clearance cutouts, at each said clearance cutout said body having two contact areas peripherally spaced with respect to each other, and each said clearance cutout shaded to support the arrow shaft at two locations; and said contact areas each formed as a generally linear surface for forming generally line contact with the arrow shaft at each of said two sections.

15. An arrow rest for supporting an arrow shaft, the arrow rest comprising:

a body having at least two clearance cutouts, at each said clearance: cutout said body having two contact areas peripherally spaced with respect to each other, and each said clearance cutout shaped to support the arrow shaft at two locations, the body having four clearance cutouts; and each said clearance cutout formed as a generally V-shaped groove having an angle of inclusion of approximately 90°.

16. An arrow rest for supporting an arrow shaft, the arrow rest comprising:

a body having at least two clearance cutouts, at each said clearance cutout said body having two contact areas peripherally spaced with respect to each other, said each said clearance cutout shaped to support the arrow shaft at two locations; and a distance between said two contact areas different at each of said at least two clearance cutouts.

17. An arrow rest according to claim 16 wherein said body has at least three flanges extending outward in a generally radial direction and forming said at least two clearance cutouts.

18. An arrow rest according to claim 17 wherein at least two of said flanges have different thicknesses.

* * * * *